United States Patent [19]

Cook

[11] Patent Number: 4,724,817

[45] Date of Patent: Feb. 16, 1988

[54] APPARATUS AND TECHNIQUE FOR SUPERCHARGING COMBUSTION ENGINES

[75] Inventor: Gary F. Cook, Renton, Wash.

[73] Assignee: GPN Enterprises, Renton, Wash.

[21] Appl. No.: 4,419

[22] Filed: Jan. 20, 1987

[51] Int. Cl.[4] ..... F02D 23/00

[52] U.S. Cl. ..... 123/565; 60/608

[58] Field of Search ..... 123/561, 565; 60/607, 60/608

[56] References Cited

U.S. PATENT DOCUMENTS 2,165,360 7/1939 Elliott ..... 123/565

2,584,033 1/1952 Laserson ..... 123/565 X

*Primary Examiner*—Stephen F. Husar

*Attorney, Agent, or Firm*—Christopher Duffy

[57] ABSTRACT

Using a differential transmission, a single stage, high speed turbo-charger-type compressor is driven by a variable speed electric motor at 30,000 revolutions per minute or greater to deliver compressed air to the engine, and the speed of the motor is controlled so as to vary the speed of the compressor within this range, commensurate with the speed of the engine.

27 Claims, 6 Drawing Figures

APPARATUS AND TECHNIQUE FOR SUPERCHARGING COMBUSTION ENGINES

TECHNICAL FIELD

This invention relates to variable speed engines operated by the combustion of an air fuel mixture therein, and more particularly, to an improved apparatus and technique for compressing the air supply to the carburetion system of such an engine to supercharge the same.

BACKGROUND ART

In the prior art, two types of compressors were used to supercharge such an engine. One type, the positive displacement compressor, was directly connected with the engine, to be driven by the same. The other type, the centrifugal compressor, was connected to a turbine wheel, to be driven by the wheel as the wheel was driven in turn by the exhaust of the engine. Since each type was directly or indirectly driven by the engine itself, each had to operate in the engine environment, including at the temperatures generated by the engine and its exhaust. As a result, each type had to inhale air that was already heated to a temperature well above that of the general atemosphere about the engine. In fact, the centrifugal compressor delivered air that was both superheated and supercharged, because it was directly exposed to the hot exhaust of the engine. This superheated condition affected the density of the air, and therefore, its capacity to be compressed. It also affected the long term operation of the compressor itself, and particularly the bearings by which the shaft of the compressor was mounted. In fact, the bearings had to be continually bathed in oil to enable them to withstand the temperatures at which they operated, and often the oil itself had to be cooled if it was to be recirculated to the bearings. Because each type of compressor was driven off of the engine, there was also a lag in the operation of it while the engine attained sufficient speed to drive it. Moreover, the speed of the compressor itself was directly affected by that of the engine. And, of course, the compressor continued to operate only so long as the engine itself was operating. The turbine-driven compressor also had the disadvantage that the exhaust system of the engine had to be interrupted to accomodate a take-off for the turbine. Often, this in turn required that the exhaust manifold had to be offset from its normal location, so that the take-off could be accomodated directly following the engine.

DISCLOSURE OF THE INVENTION

One object of the present invention is to provide an apparatus and technique whereby the compressed air can be delivered to the carburetion system of the engine at a temperature more typical of the general atmosphere about the compressor, than of the region directly surrounding the engine. Another object is to provide an apparatus and technique of this nature whereby the air can be delivered at increased pressures, relative to those at which the air was delivered in the prior art; and whereby, therefore, higher horsepower ratings can be attained for the engine, than were attained for engines supercharged by apparatus and techniques employed in the prior art. A still further object is to provide an apparatus and technique of this nature whereby the air can be delivered to the carburetion system by a compressor which does not require oil fed bearings, nor bearings which are fed with oil recirculated through a cooler for the same. Still another object is to provide an apparatus and technique of this nature wherein the compressor can be driven independently of the engine so that it is possible to activate and deactivate the compressor at will, and moreover, to deliver compressed air to the carburetion system relatively immediately, rather than after a lag such as that which characterized apparatus employed in the prior art. It is also an object in this connection, to provide an apparatus and technique of this nature wherein the compressor can be activated even before the engine is running, or if desired, only after the engine has reached a predetermined speed. Other objects include providing an apparatus and technique of this nature wherein the engine speed at which the compressor is activated, can be varied at will, such as through the selection of the same by an operator. Furthermore, the invention has the object of providing an apparatus and technique of this nature wherein these various advantages can be obtained without adding more weight to the arrangement than was added by superchargers employed in the prior art; and in fact, wherein the weight of the arrangement can be reduced as compared with the weight which was added by those apparatus employed in the prior art. Still other objects include providing an apparatus and technique of this nature wherein there is no need to interrupt the engine exhaust, as was necessary in the prior art; nor any necessity for connecting the apparatus with the engine itself, other than through an air delivery connection between the compressor and the carburetion system of the engine.

According to the inventive technique, these objects and advantages are realized by a combination of steps including interconnecting the discharge outlet of a single stage, high speed centrifugal air compressor with the carburetion system of the engine, and interconnecting the power output shaft of a variable speed electric motor with the impeller of the compressor through a differential transmission. The compressor has an inlet which opens into the ambient atmosphere of the compressor for the intake of air therefrom; and the motor is electrically activated to drive the impeller and deliver compressed air to the carburetion system of the engine. The motor and the transmission are adapted, moreover, to rotate the impeller within a range of 30,000 revolutions per minute or greater; and the speed of the motor is controlled so as to vary the speed of the impeller within this range, commensurate with the speed of the engine. The combination of steps makes it possible to mount the compressor independently of the engine, and moreover, to space it apart from the engine at a location where its ambient atmosphere is substantially unheated by the engine. As a consequence, the compressor intakes substantially cold ambient air, and compresses and forces it into the carburetion system of the engine at maximum air density. Furthermore, the compressor itself generates very little heat, and therefore, the bearings for the impellor shaft are subjected to little or no heat, other than that generated by compressing the air. As a result, sealed mechanical bearings, such as roller bearings, can be used to journal the shaft of the compressor, and the oil for the bearings need not be continually replenished with new oil to preserve their usefulness. Moreover, there is no need to cool the oil, or provide protection otherwise against overheating.

Because the compressor is driven independently of the engine, the combination also makes it possible to activate the compressor at will; and each time the compressor is activated, to deliver compressed air to the carburetion system, relatively immediately, rather than after a lag such as that which characterized apparatus that was directly or indirectly coupled to the engine in the prior art. In fact, if desired, the compressor can be activated even before the engine is running; or if desired, it can be activated only after the engine has reached a predetermined speed. Furthermore, the engine speed at which the compressor is activated, can be varied at will, such as through the selection of the same by an operator. Where the compressor is used on a vehicle, this enables the operator to key the use of the compressor to weather conditions, or road or water on atmospheric conditions around him, depending on the vehicle in which the compressor is used.

In similar fashion, the compressor can be deactivated at any time, including when the engine is running. Typically, the speed of the motor is controlled by varying the current flow to the motor; and in similar fashion, the compressor is activated and deactivated by initiating or interrupting current flow to the motor.

Normally, the current is supplied from a separate power source than that employed in the operation of the engine.

The combination does not add any weight to the overall apparatus, as compared with the prior art direct driven or turbine driven apparatus; and in fact, the weight of the apparatus is normally less than that typical of these prior art apparatus.

There is also no need to interrupt the engine exhaust, as was the case with the turbine driven apparatus used in the prior art.

Most important, the combination provides a higher pressure boost to the carburetion system than was possible in the prior art. For example, pressure boosts of 1½ psi have been experienced, resulting in rear wheel horsepower increases of 16% for 1400 cc automobile engines tested at 6000 rpm in third gear at 65 mph. It is also possible to achieve the maximum boost at a far lower engine speed than was needed for prior art apparatus; and to achieve a boost at any engine speed, including idling speed. Furthermore, by operating independently of the engine, the combination relieves the engine of the drag which prior art apparatus imposed on the engine, thus allowing the engine itself to perform at greater horsepower.

As indicated, the speed of the motor may be controlled by varying the current flow to the motor. In certain presently preferred embodiments of the invention, the speed of the engine and the current flow to the motor are simultaneously varied; whereas in other presently preferred embodiments of the invention, the speed of the engine is detected, and the current flow to the motor is varied, commensurate with the speed of the engine.

As was also indicated, the current flow to the motor may be varied commensurate with the speed of the engine, only after the engine has reached a threshhold speed. This threshhold speed may be selectively varied from time to time, and it may be selectively varied while the engine is running.

The inventive apparatus comprises a single stage, high speed centrifugal air compressor having a discharge outlet in the case thereof for interconnection with the carburetion system of the engine, to supply air thereto, and an inlet which opens into the ambient atmosphere of the compressor for the intake of air therefrom. A power input shaft is rotatably journaled in the compressor on the axis thereof, and the shaft has an impeller thereon which is adapted to cooperate with the case in inhaling ambient air through the inlet, and discharging it under pressure through the outlet at 30,000 revolutions per minute or greater. The apparatus also comprises a variable speed electric motor having a power output shaft, and adapted to be operatively interconnected with an electric power source, to be powered by the same. There are means for transmitting the rotation of the power output shaft of the motor to the power input shaft of the compressor when it is desired to supercharge the air supply to the carburetion system. There is a differential in the transmission means, moreover, to vary the speed of one shaft over the other, so that together, the motor and the transmission means are capable of rotating the impeller of the compressor at 30,000 revolutions per minute or greater. The apparatus also comprises a variable speed electric motor having a power output shaft, and adapted to be operatively interconnected with an electric power source, to be powered by the same. There are means for transmitting the rotation of the power output shaft of the motor to the power input shaft of the compressor when it is desired to supercharge the air supply to the carburetion system. There is a differential in the transmission means, moreover, to vary the speed of one shaft over the other, so that together, the motor and the transmission means are capable of rotating the impeller of the compressor at 30,000 revolutions per minute or greater. In addition, there are means for controlling the speed of the motor to vary the speed of the impeller within the aforesaid range, commensurate with the speed of the engine.

In many of the presently preferred embodiments of the invention, the motor speed control means include power control means which are responsive to variation in the engine speed to vary the current flow to the motor, commensurate with the engine speed. Where there are operator adjustable control means for varying the speed of the engine, the power control means may be interconnected with the same to vary the current flow to the motor, commensurate with the operator adjustment in the speed of the engine. Or where there are means for detecting the speed of the engine, the power control means may be interconnected with the same to vary the current flow to the motor, commensurate with variation in the speed of the engine.

Again, the power control means may be operable to vary the current flow to the motor, commensurate with variation in the speed of the engine, only after the engine has reached a threshhold speed. And the apparatus may further comprise operator adjustable selector means for varying the threshhold engine speed at which the power control means are operable to vary the current flow to the motor commensurate with variation in the speed of the engine. The selector means may be operable, moreover, to vary the threshhold engine speed while the engine is running.

Normally, the apparatus further comprises means for initiating and interrupting current flow to the motor when it is desired to activate and deactivate the compressor, respectively.

BRIEF DESCRIPTION OF THE DRAWINGS

These features will be better understood by reference to the accompanying drawings which illustrate two presently preferred embodiments of the invention that have been used as a kit to retrofit an automobile engine with a supercharger.

In the drawings.

BEST MODE FOR CARRYING OUT THE INVENTION

Figure 1:
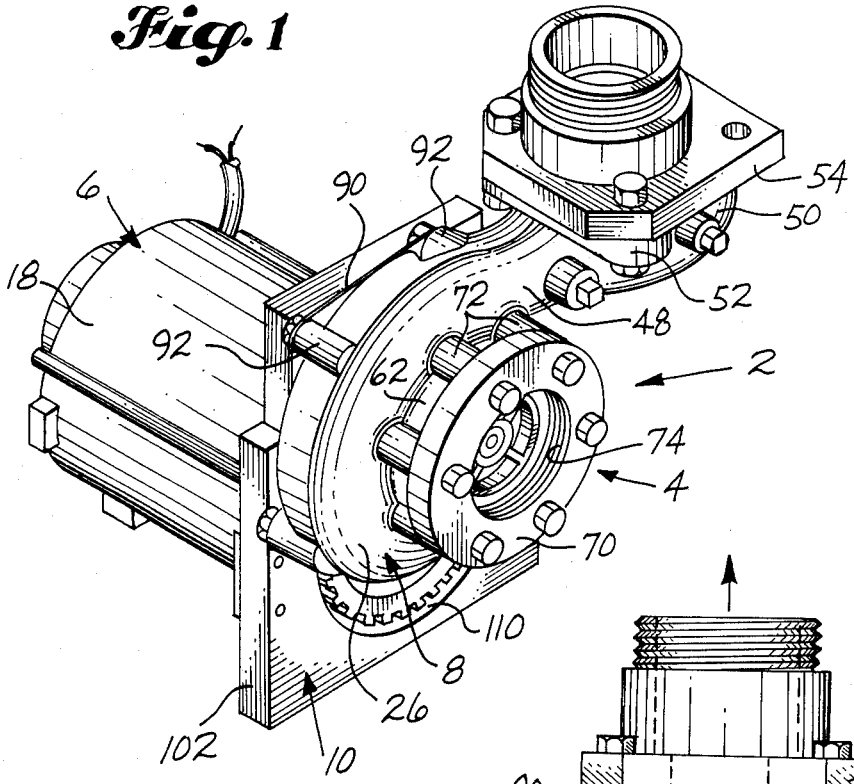
FIG. 1 is a perspective view of the supercharger in the kit.
Figure 3:
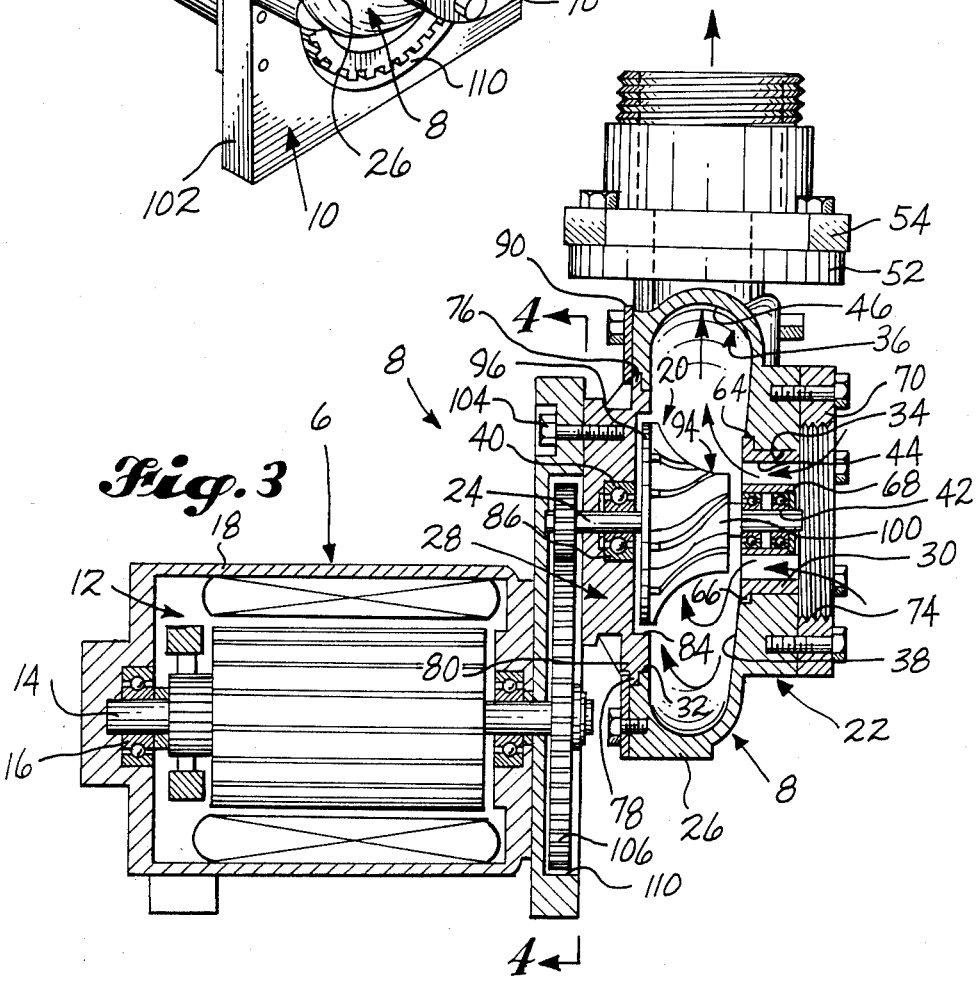
FIG. 3 is a cross-sectional view of the supercharger along the line 3-3 of FIG. 2.

Referring to the drawings, it will be seen that the supercharger 2 in the kit comprises a motor-driven turbocharger-type compressor unit 4 which in turn comprises a variable speed DC electric motor 6, a single stage, high speed centrifugal compressor 8, and a differential gear transmission 10 for driving the compressor from the motor. The motor 6 is conventional and comprises an armature 12 having a shaft 14 which is rotatably mounted in a pair of bearings 16 in the end walls of the motor housing 18. The compressor 8 comprises an impeller 20, a housing 22 for the same, and a shaft 24 for rotatably mounting the impeller in the housing. The housing 22 comprises an annular case 26 for the impeller, and a pair of flanged end supports 28 and 30 for the shaft 24 of the impeller. The end supports 28 and 30 are mounted in the left and right hand axial openings 32 and 34 of the case, respectively, in FIG. 3, and in turn support a pair of radial and thrust bearings 40 and 42 to provide journals for the shaft 24. The case 26 itself has a generally torroidal chamber 36 formed therein, the right hand side 38 of which in FIG. 3, is mitered to the axis of the case to cooperate with the impeller 20 in discharging compressed air from the case in known fashion. In operation, the impeller intakes ambient air through an annular opening 44 formed about the right hand bearing 42 of the shaft, and discharges the air under pressure through a port 46 in the body of the case 26, at the periphery thereof. The port 46 opens into a tangential extension 48 of the case, which cantilevers from the compressor to one side thereof and has a right angular elbow 50 upstanding from the outlying end thereof. The elbow 50 is widely flanged at its top 52, and has a threaded coupling 54 capscrewed to the same to enable a duct 56 (FIGS. 5 and 6) to be interconnected with the supercharger. The duct 56 transports the compressed air from the compressor to the carburetion system 58 of the diesel or internal combustion engine 60 of the automobile, as shall be explained.

Referring now to the details of the supercharger 2, it will be seen that the right hand side of the case 26 has a turreted hub 62 formed about the axial opening 34 thereof. The hub is rabbeted at the inner peripheral edge 64 thereof to receive the flange 66 of the right hand end support 30 for the shaft 24, and the support is telescopically engaged in the opening 34 until the flange 66 of the same abuts within the rabbet 64. The shaft 24 is then journaled in a sleeve 68 which is spider mounted in the opening 44 of the support and has the bearing 42 supported therein. In addition, a coupling ring 70 is capscrewed to the threaded turrets 72 of the hub 62, to provide internal threading 74 with which to attach a duct (not shown) to the compressor 8, should one choose to extend the intake opening 44 of the same.

The axial opening 32 at the left hand side of the case 26 is larger in diameter and is rabbeted about the outer peripheral edge 76 thereof. The left hand support 28 for the shaft 24 is telescoped within the opening 32 and has a rabbet 78 in the flange 80 thereof, which interengages with the rabbet 76 at the outer peripheral edge of the opening 32. The support 28 is also rabbeted at the right hand inner peripheral edge 84 thereof, to form a seat 86 for the bearing 40, and a shallower but wider diameter recess 84 within which to accomodate the adjacent end 96 of the impeller 20. The support 28 is clamped to the case by means of a flat retainer ring 90 which is capscrewed to turrets 92 on the left hand face of the case, to overlie the flange 80 of the support.

Figure 2:
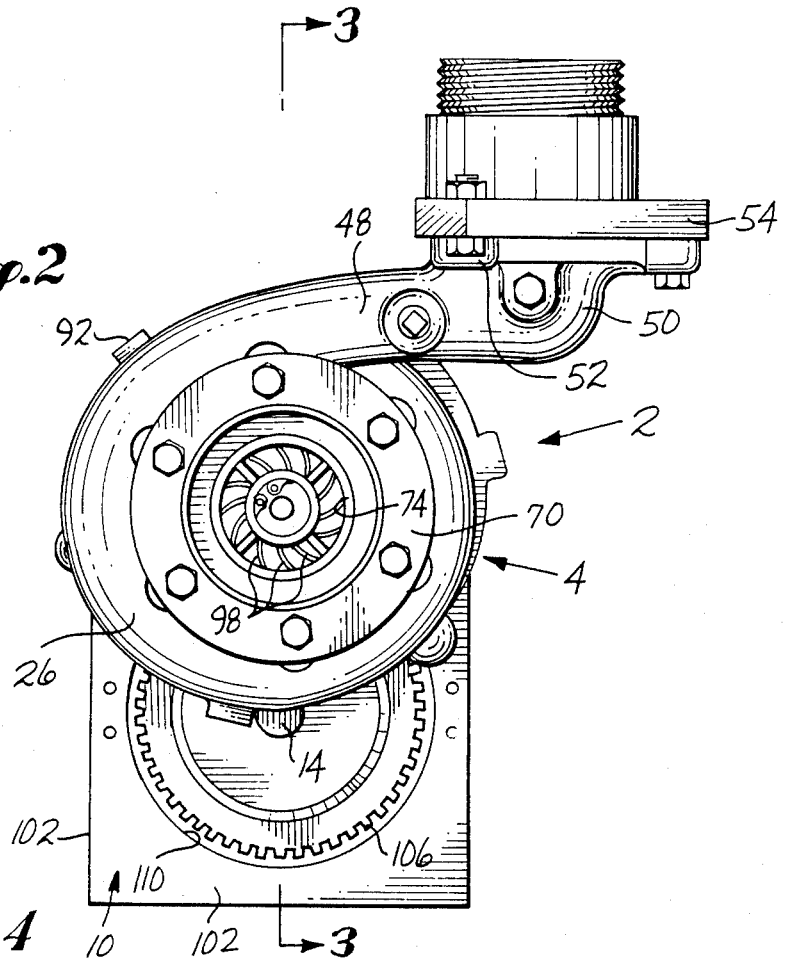
FIG. 2 is an end view of the supercharger from the right hand side of FIG. 1.
Figure 4:
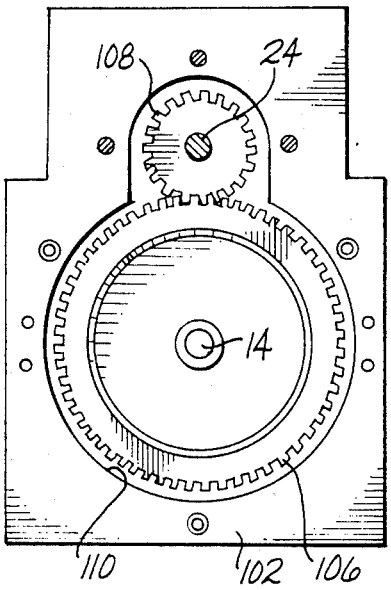
FIG. 4 is a cross-sectional view of the supercharger along the line 4-4 of FIG. 3.

The impeller 20 comprises a generally truncated conical wheel 94 which has a disc-shaped hub 96 at the left hand end thereof, and a series of symmetrically angularly spaced blades or vanes 98 (FIG. 2) arrayed about the right hand end 100 thereof. The vanes 98 are concavely edged and have a swirled configuration to intake air from the right hand or apex end 100 of the wheel and discharge it radially outwardly of the axis of the wheel.

The transmission 10 comprises a flat, rectangular case 102 which is interposed between the right and left hand ends of the motor 6 and the compressor 8, respectively, and secured to the same by cap screws 104 threaded into the faces of the same. Spur gears 106 and 108 are affixed to the corresponding ends of the shafts 14 and 24 of the motor and the compressor, and are peripherally intermeshed with one another in a key-hole-shaped recess 110 formed in the right hand side of the case 102. The gears are sized to provide a differential between the speed of the motor shaft 14 and that of the compressor shaft 24, consistent with the use to be made of the supercharger, as shall be explained.

Figure 5:
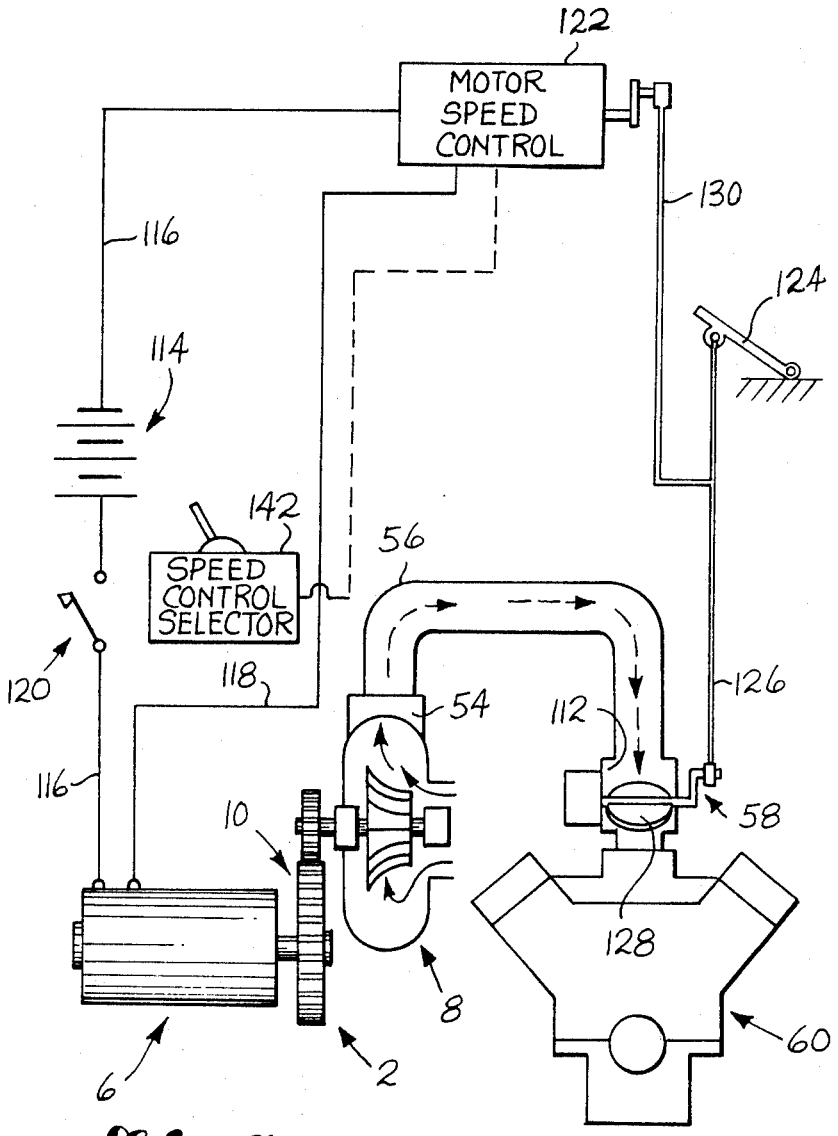
FIG. 5 is a schematic illustration of the automobile engine when it has been retrofitted from the kit in accordance with one of the embodiments.

Referring now to FIG. 5, it will be seen that the supercharger 2 is mounted on the automobile (not shown) independently of the engine 60 thereof, but interconnected with the air intake 112 of the carburetor 58 of the engine by the duct 56 extending therebetween. A 12 volt battery 114 is employed to power the motor 6, and the battery 114 and motor are interconnected in a circuit comprising the leads 116 and 118. An on/off switch 120 is interposed in the circuit 116,118, to be opened and closed as desired for purposes of actuating and deactuating the supercharger. A rheostat 122 is also interposed in the circuit, to enable the current flow to the motor 6 to be varied for purposes of controlling the speed of the compressor 8. The rheostat 122 is controlled by the operator of the automobile as he varies the speed of the engine 60 through the accelerator pedal 124 to the carburetor 58. As seen in FIG. 5, there is a conventional linkage 126 between the carburetor butterfly valve 128 and the accelerator pedal 124 in the cab (not shown) of the automobile, by which the operator controls the speed of the engine in conventional fashion. In accordance with the invention there is also a linkage 130 between the carburetor linkage 126 and the rheostat 122, whereby the rheostat is responsive to operator adjustment of the butterfly valve 128, to vary the speed of the impellor 20 of the compressor, commensurate with the speed of the engine. This in turn varies the pressure of the air supplied to the carburetor 58.

Figure 6:
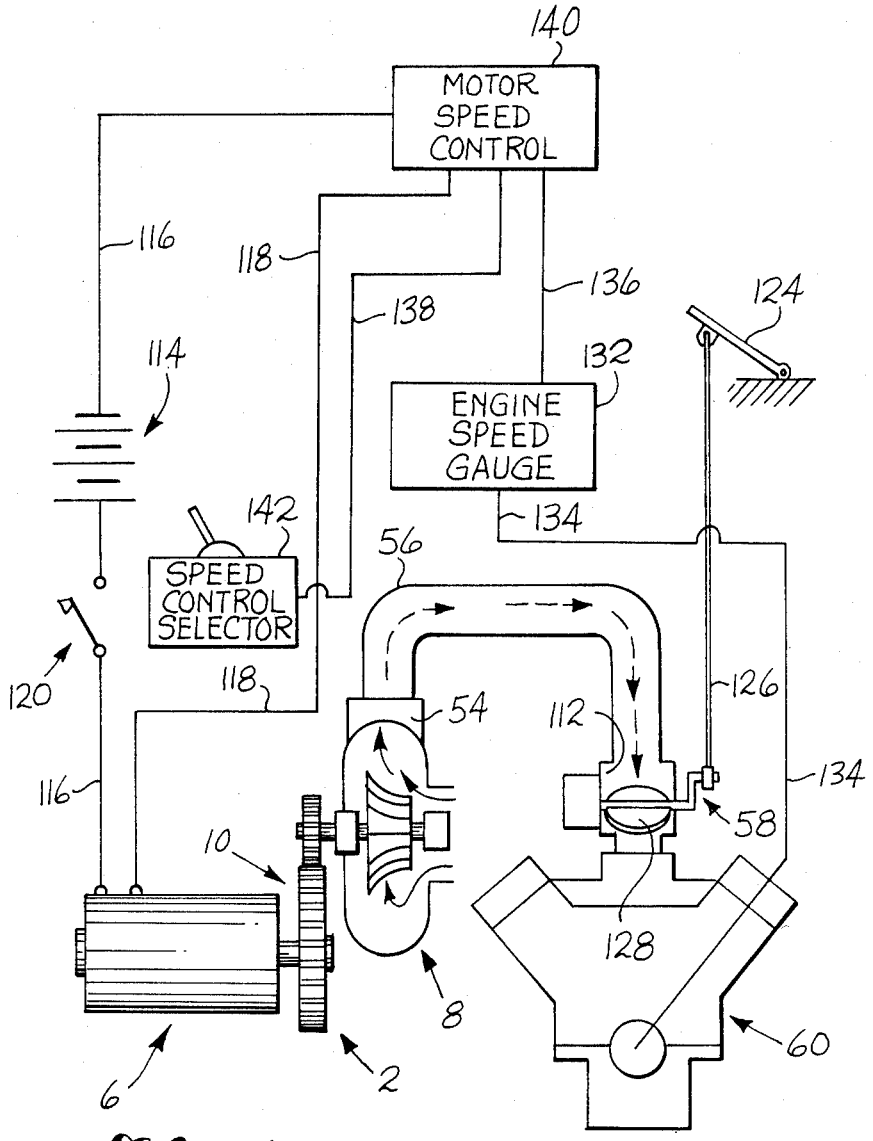
FIG. 6 is a schematic illustration of the automobile engine when it has been retrofitted in accordance with the other embodiment.

Alternatively, a tachometer 132 may be interconnected with the engine at 134 to gauge the speed of the engine, as in FIG. 6; and a microprocessor 140 may be interposed in the circuit 116, 118 of the motor 6 to monitor the speed of the engine at 136, and control the speed of the impeller, commensurate with the speed of the engine, by varying the current flow to the motor. If desired, moreover, the microprocessor 140 may be adapted to control the speed of the impeller only after the engine reaches a predetermined threshhold speed, such as 1200 rpm. Thereafter, the microprocessor would control the speed of the impellor, commensurate with the speed of the engine, for any desired range or up to any desired maximum, such as 3,000 rpm.

Additionally, the operator may select the speed at which the microprocessor commences control of the speed of the impeller. As seen in FIG. 6, a selector control 142 may be mounted on the dashboard of the cab of the automobile, together with the switch 120, to enable the operator to regulate the engine speed at which the microprocessor commences control of the impeller speed.

Similarly, and referring again to FIG. 5, the operator may be equippped with a dashboard-mounted selector control 142 for regulating the condition in which the rheostat commences control of the speed of the impeller. Or in the alternative, the operator may have access to the rheostat for purposes of resetting the threshhold speed at which the rheostat commences control of the speed of the impeller.

If desired, the microprocessor 140 may also sense the fuel flow to the engine 60 and regulate it as well, commensurate with the current flow, and vice versa.

The battery 114 is normally additional to that (not shown) used in starting the engine 60.

The bearings 40 and 42 may be sealed ball bearings, as shown, or roller bearings, or some other type of bearing normally used to support a high speed shaft journaled therein.

A cobalt magnet motor may be used to drive the compressor 8 at the requisite speeds through the gear pair 106, 108. Preferably, the compressor is driven at speeds of 50,000 revolutions per minute or greater.

What is claimed:

1. A method of compressing the air supply to the carburetion system of a variable speed engine operated by the combustion of an air fuel mixture therein, comprising:

interconnecting the discharge outlet of a single stage, high speed centrifugal air compressor with the carburetion system of the engine, interconnecting the power output shaft of a variable speed electric motor with the impeller of the compressor through a differential transmission, the compressor having an inlet which opens into ambient atmosphere of the compressor for the intake of air therefrom, electrically activating the motor to drive the impeller and deliver compressed air to the carburetion system of the engine, the motor and the transmission being adapted to rotate the impeller within a range of 30,000 revolutions per minute or greater, and the speed of the motor being controlled so as to vary the speed of the impeller within the aforesaid range, commensurate with the speed of the engine.

2. The method according to claim 1 wherein the compressor is spaced apart from the engine at a location where its ambient atmosphere is substantially unheated by the engine.

3. The method according to claim 1 wherein the shaft of the impeller is journaled in sealed mechanical bearings.

4. The method according to claim 1 wherein the compressor is activated before the engine is running.

5. The method according to claim 1 wherein the motor is activated to drive the compressor before the engine is running.

6. The method according to claim 1 wherein the compressor is activated only after the engine has reached a predetermined speed.

7. The method according to claim 6 further comprising varying the engine speed at which the compressor is activated.

8. The method according to claim 1 further comprising deactivating the compressor when the engine is running.

9. The method according to claim 1 wherein the compressor is activated and deactivated by initiating and interrupting current flow to the motor, respectively.

10. The method according to claim 1 wherein the motor is electrically activated by a separate power source than that employed in the operation of the engine.

11. The method according to claim 1 wherein the engine is mounted on a vehicle, and the compressor and motor are likewise mounted on the vehicle.

12. The method according to claim 1 wherein the speed of the motor is controlled by varying the current flow to the motor.

13. The method according to claim 12 wherein the speed of the engine and the current flow to the motor are simultaneously varied.

14. The method according to claim 12 wherein the speed of the engine is detected and the current flow to the motor is varied commensurate with the speed of the engine.

15. The method according to claim 12 wherein the current flow to the motor is varied commensurate with the speed of the engine, only after the engine has reached a threshhold speed.

16. The method according to claim 15 wherein the threshhold engine speed is selectively varied from time to time.

17. The method according to claim 15 wherein the threshhold engine speed is selectively varied while the engine is running.

18. Apparatus for compressing the air supply to the carburetion system of a variable speed engine operated by the combustion of an air fuel mixture therein, comprising:

a single stage, high speed centrifugal air compressor having a discharge outlet in the case thereof for interconnection with the carburetion system of the engine, to supply air thereto, and an inlet which opens into the ambient atmosphere of the compressor for the intake of air therefrom, a power input shaft rotatably journaled in the compressor on the axis thereof, and having an impeller thereon which is adapted to cooperate with the case in inhaling ambient air through the inlet, and discharging it under pressure through the outlet at 30,000 revolutions per minute or greater, a variable speed electric motor having a power output shaft, and adapted to be operatively interconnected with an electric power source to be powered by the same, means for transmitting the rotation of the power output shaft of the motor to the power input shaft of the compressor when it is desired to supercharge the air supply to the carburetion system, there being a differential in the transmission means to vary the speed of one shaft over the other, so that together, the motor and the transmission means are capable of rotating the impeller of the compressor at 30,000 revolutions per minute or greater, and means for controlling the speed of the motor to vary the speed of the impeller within said range, commensurate with the speed of the engine.

19. The apparatus according to claim 18 wherein the motor speed control means include power control means responsive to variation in the engine speed to vary the current flow to the motor commensurate with the engine speed.

20. The apparatus according to claim 19 wherein there are operator adjustable control means for varying the speed of the engine, and the power control means are interconnected with the engine speed control means to vary the current flow to the motor commensurate with the operator adjustment in the speed of the engine.

21. The apparatus according to claim 19 wherein there are means for detecting the speed of the engine, and the power control means are interconnected with the engine speed detection means to vary the current flow to the motor commensurate with variation in the speed of the engine.

22. The apparatus according to claim 19 wherein the power control means are operable to vary the current flow to the motor, commensurate with variation in the speed of the engine, when the engine has reached a threshhold speed.

23. The apparatus according to claim 22 further comprising operator adjustable selector means for varying the threshhold engine speed at which the power control means are operable to vary the current flow to the motor commensurate with variation in the speed of the engine.

24. The apparatus according to claim 23 wherein the selector means are operable to vary the threshhold engine speed while the engine is running.

25. The apparatus according to claim 18 further comprising means for initiating and interrupting current flow to the motor when it is desired to activate and deactivate the compressor, respectively.

26. The apparatus according to claim 18 wherein the power input shaft of the compressor is journaled in sealed mechanical bearings.

27. In combination, an engine operated by the combustion of an air fuel mixture therein, a carburetion system for supplying the air fuel mixture to the engine, and means for supplying air to the carburetion system, including a single stage, high speed centrifugal air compressor having a discharge outlet in the case thereof, and an inlet which opens into the ambient atmosphere of the compressor for the intake of air therefrom a power input shaft rotatably journaled in the compressor on the axis thereof, and having an impeller thereon which is adapted to cooperate with the case in inhaling ambient air through the inlet, and discharging it under pressure through the outlet at 30,000 revolutions per minute or greater, a variable speed electric motor having a power output shaft, an electric power source operatively interconnected with the motor to power the same, duct means interconnecting the outlet of the compressor with the carburetion system of the engine, for the supply of air thereto, means for transmitting the rotation of the power output shaft of the motor to the power input shaft of the compressor when it is desired to supercharge the air supply to the carburetion system, there being a differential in the transmission means to vary the speed of one shaft over the other, so that together, the motor and the transmission means are capable of rotating the impeller of the compressor at 30,000 revolutions per minute or greater, and means for controlling the speed of the motor to vary the speed of the impeller within the aforesaid range, commensurate with the speed of the engine.

* * * * *